US006637728B2

(12) United States Patent
Pettit et al.

(10) Patent No.: US 6,637,728 B2
(45) Date of Patent: Oct. 28, 2003

(54) PLASTIC PRIVACY FENCE

(75) Inventors: Fredrick M. Pettit, Fonthill (CA); Laurie D. Higgins, Hawkestone (CA)

(73) Assignee: GSW Inc., Toronto ( * ) Notice: Subject to any disclaimer, the term of this patent is extended or adjusted under 35 U.S.C. 154(b) by 0 days.

(21) Appl. No.: 09/892,522

(22) Filed: Jun. 28, 2001

(65) Prior Publication Data

US 2002/0000544 A1 Jan. 3, 2002

(30) Foreign Application Priority Data

Jun. 29, 2000 (CA) ..... 2312694

(51) Int. Cl.[7] ..... E04H 17/14

(52) U.S. Cl. ..... 256/19; 256/24; 256/59; 256/65.15

(58) Field of Search ..... 256/1, 19, 24, 256/25, 27, 59, 65.01–65.07, 65.15, 21, 73; 403/292, 294; 521/773, 764, 630, 581, 589.1, 592.1; 264/523, 527, 531, 534

(56) References Cited

U.S. PATENT DOCUMENTS

| | | | | | |
|---|---|---|---|---|---|
| 1,965,883 | A | * | 7/1934 | Cotton | |
| 3,406,946 | A | * | 10/1968 | Saultz | |
| 3,662,410 | A | * | 5/1972 | Lankheet | 4/172.12 |
| 5,480,126 | A | * | 1/1996 | Teasdale | 256/19 |
| 5,601,279 | A | * | 2/1997 | Schwartz et al. | 256/66 |
| 5,702,090 | A | * | 12/1997 | Edgman | 256/19 |
| 6,202,987 | B1 | * | 3/2001 | Forbis | 256/24 |
| 6,253,511 | B1 | * | 7/2001 | Boyer | 52/302.4 |
| 2001/0004816 | A1 | * | 6/2001 | Boyer | 52/235 |

FOREIGN PATENT DOCUMENTS

| | | | | |
|---|---|---|---|---|
| EP | 282269 | * | 9/1988 | 256/19 |
| FR | 2102577 | * | 4/1972 | 256/65.15 |
| GB | 112 | * | 3/1858 | 256/21 |

* cited by examiner

*Primary Examiner*—Lynne H. Browne
*Assistant Examiner*—Michael P. Ferguson

(57) ABSTRACT

A plastic fence section comprises a series of connected hollow chambers with at least upper and lower horizontal chambers extending the length of the fence section for receiving reinforcing members. The fence section is made of plastic material. The hollow chambers are separated by pinch off regions. The fence section provides a visual block and has a similar appearance on either side of the fence section. The fence section has a post edge and a panel joining edge. The panel joining edge is adapted to engage and overlap with a second fence panel section.

11 Claims, 10 Drawing Sheets

PLASTIC PRIVACY FENCE

FIELD OF THE INVENTION

The present invention relates to plastic fences, and in particular, relates to molded plastic fence sections having reduced components for ease of assembly.

BACKGROUND OF THE INVENTION

Individual plastic extruded components for use as fence components are widely known and have had varying degrees of success in the market place. Plastic fence systems generally are lightweight, have good structural strength, can be reinforced, and are low maintenance. In today's busy environment, there is a desire to provide the end customer with a fence product which is easy to install and convenient to transport. To partially satisfy this demand, it is known to produce wood and/or plastic fence sections where various pieces of the fence section have been preassembled in the factory or at the distribution outlet to provide large complete fence sections.

Unfortunately, due to the significant labour content required to assemble the fence sections, the cost is relatively high. In some cases, as a cost saving measure, the assembly can be done by the end purchaser, however, the extruded plastic fence sections, in particular, are relatively complicated and have a number of different extruded products which must be preassembled in a particular manner.

There remains a need for a fence system which is more practical and which can be assembled in a relatively straightforward manner.

SUMMARY OF THE INVENTION

A plastic fence section for securement between two posts according to the present invention comprises two identical panels with each panel including a post engaging edge and a panel joining edge. The panels are reversible such that the post engaging end can be positioned at the right edge or at the left edge as required. Each panel includes at least two parallel horizontal chambers extending across the panels and joining with the respective horizontal chambers of the other panel. At least two reinforcing members extend through the horizontal channels and extend the length of the fence section. These horizontal reinforcing members are concealed within the fence section and allow suspension of the fence section between the end posts.

According to an aspect of the invention, the fence section includes three horizontal chambers and three reinforcing members extending the length of the fence section and concealed within the fence section.

According to a further aspect of the invention, the panel joining edge of each panel includes interlocking surfaces which interfit with the interlocking surfaces of the joining panel section.

According to yet a further aspect of the invention, the panel joining edge is divided vertically to provide a male connecting portion to one side of the vertical division and a corresponding female connecting portion to the opposite side of the vertical division.

A plastic privacy fence panel according to the present invention, comprises at least an upper hollow horizontal member and a lower horizontal member with both of these members extending the length of the fence panel and forming hollow cavities for receipt of a reinforcing member. The privacy fence panel comprises an upper top finished portion, a middle portion between the horizontal members and a bottom portion extending below the lower horizontal member. Each of the portions comprise a series of hollow chambers separated by pinch off regions of additional thickness relative to the thickness of the walls of the hollow chambers. The portions of the privacy fence panel cooperate with the horizontal members to provide a visual block across the width and height of the privacy fence panel.

According to yet a further aspect of the invention, each panel is a single integral piece.

According to yet a further aspect of the invention, each panel is manufactured by a blow molding technique.

In yet a further aspect of the invention, each panel is symmetrical between opposed vertical edges of the panel relative to a vertical plane extending along the panel.

According to yet a further aspect of the invention, each panel includes a post joining panel edge at one vertical edge of the panel and a slip joint edge on an opposite vertical edge of the panel.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
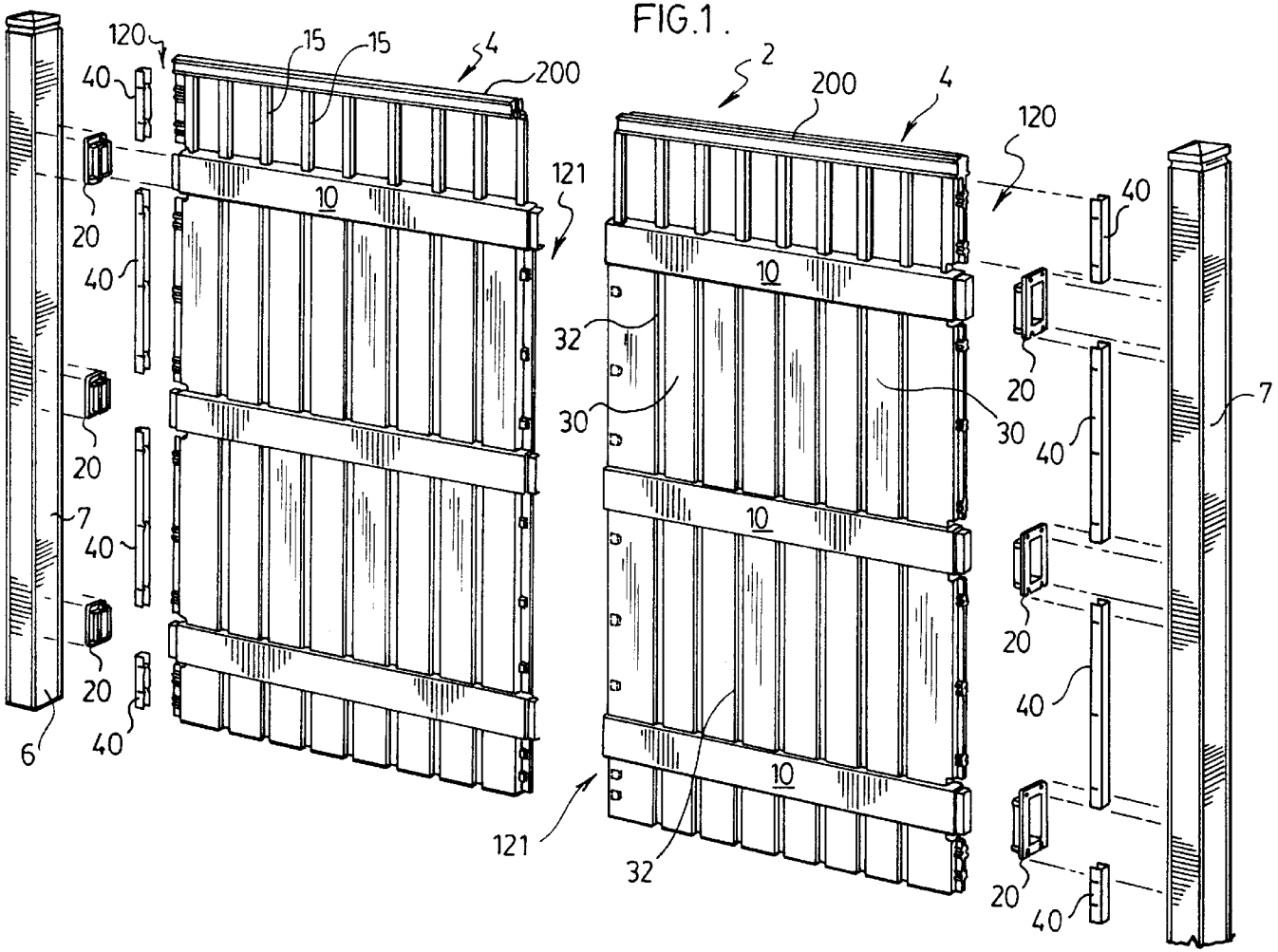
FIG. 1 is an exploded front perspective view showing two panels for securement between two posts.
Figure 2:
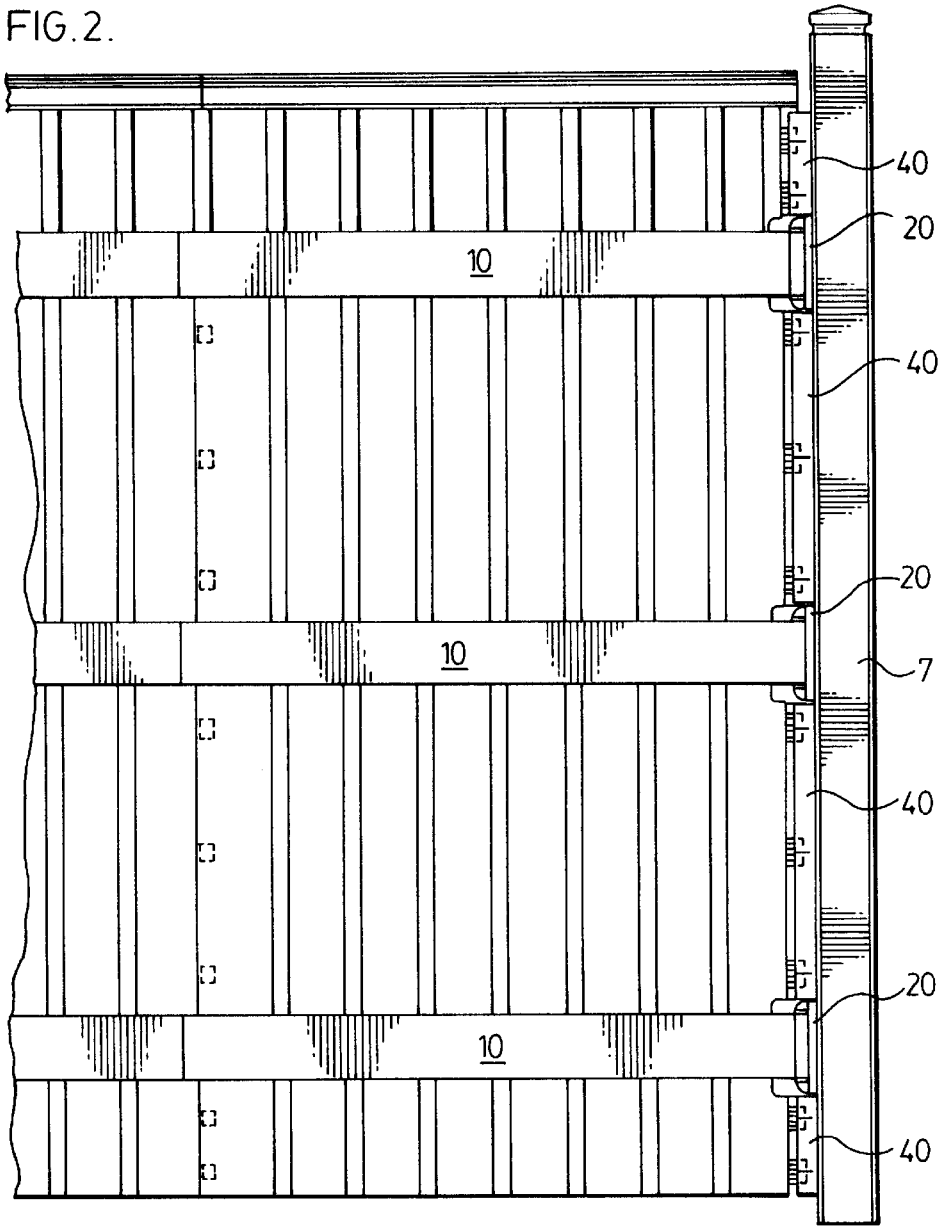
FIG. 2 is a partial front view of two panels.

The plastic fence section 2 of FIG. 1 includes two fence panels 4 which are interconnected and supported between two spaced posts 6 having blow molded single piece post covers 7. Each of the fence panels include three horizontal rails per panel and these rails 10 are effectively cavities shaped for receiving a reinforcing member such as a wooden two-by-four. The fence panels are manufactured by blow molding and are of a size of approximately four feet by six feet. Each fence panel 4 is a single piece blow molded plastic component.

The fence section includes six connectors 20, and eight C-shaped channels 40 for engaging the post edge 120 of each panel, and provides a visual block between the panel and post.

Figure 3:
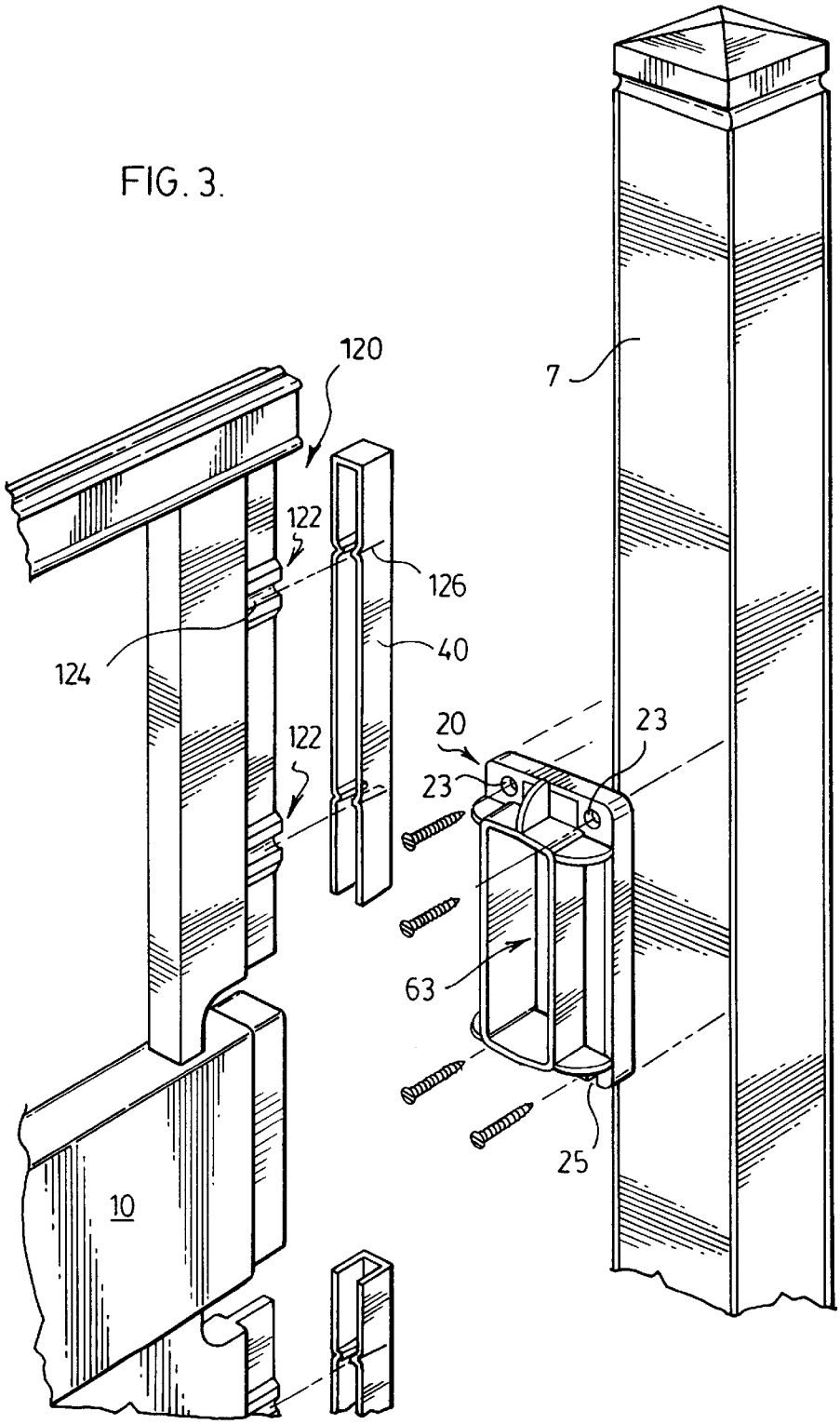
FIG. 3 is an exploded partial perspective view showing securement of a panel to a post.

As shown in FIG. 3, the post cover 7 and the underlying four by four wooden post receive and secure the connector 20. The connector includes an open center port 63 for receiving the two by four reinforcing member extending out of the chamber 10. The post cover and cap are a single integral piece made by blow molding. The corners of the post cover are U-shaped expansion beads which accommodate tolerance variations common with wooden four by fours.

Figure 11:
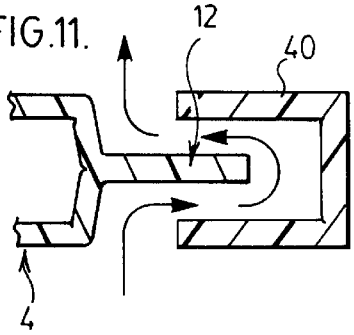
FIG. 11 is a sectional view of a fence panel and a C-shaped member allowing air to pass therebetween.
Figure 12:
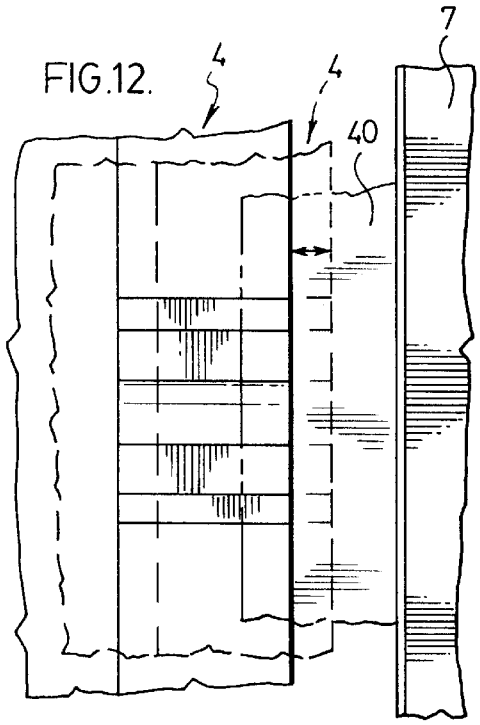
FIG. 12 is a partial front view of the C-shaped connector and its spring relationship with the panel edge.
Figure 13:
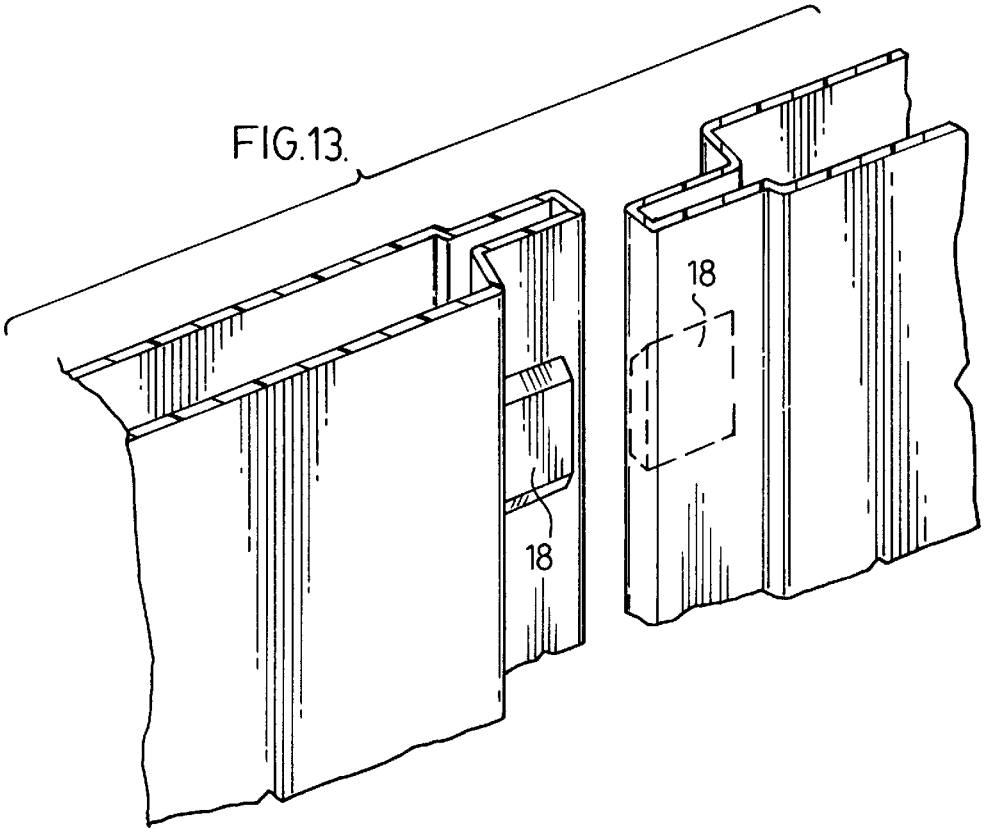
FIG. 13 is a partial perspective view showing the connection of panels at the center between posts.

The C-shaped channel 40 is trapped between the post cover and the panel edge 120. Edge 120 includes raised pads 122 which have opposed center recesses 124. C-shaped channel 40 includes inwardly set wedge members 126 which are received in recesses 124 and form an interference fit therewith. This creates a spring bias pushing the C-shaped channel against the post. With thermal expansion of the panel, the panel moves against the spring bias deeper in the channel as shown in FIG. 12. In addition to forming a visual block at the post, the channel also allows wind to flow through the fence as shown in FIG. 11.

Figure 4:
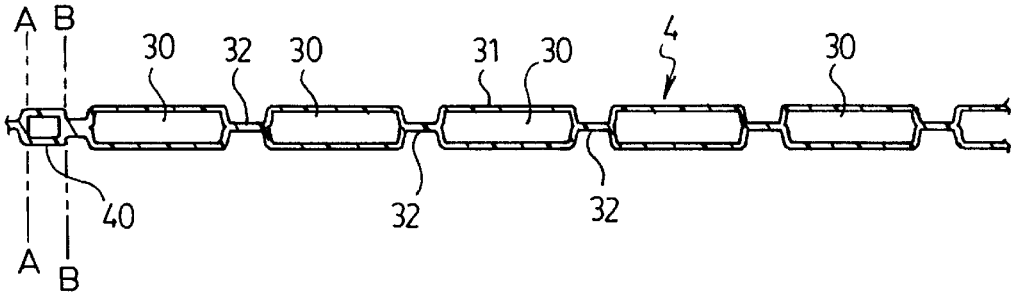
FIG. 4 is a partial horizontal section through a fence panel.

A typical section through the fence panel is shown in FIG. 4. As can be seen, the blow molding technique defines a number of chambers 30 with each chamber providing an outer configuration resembling a board. In between the chambers 30 are pinch off areas 32 which are of a double wall thickness and provide vertical stiffening. The individual boards 31 are interrupted by the horizontal reinforcing cavities 10. These cavities extend across the width of the fence panel and join with like cavities of the adjoining fence panel.

Figure 14:
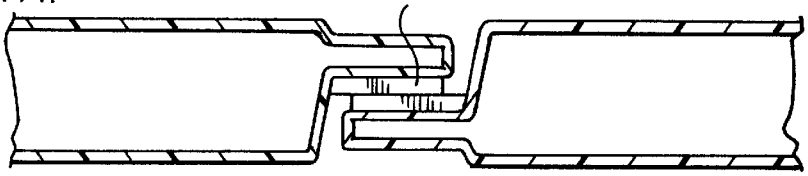
FIG. 14 is a sectional view through two overlapping panels and the contact pads.
Figure 15:
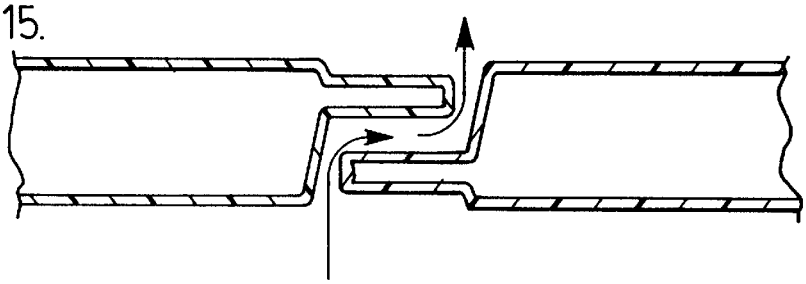
FIG. 15 is a section similar to FIG. 13 but below abutment pads defining an air passage gap.

Each fence panel includes a post engaging edge 120 and a panel engaging edge 121. The panels are reversed such that the panel engaging edge of one panel meets and cooperates with the panel engaging edge of the adjoining panel and collectively form a fence section. The horizontal members interconnect by means of a slip joint generally shown as 16 (see FIGS. 7 and 8). The panel engaging edge 121 includes an offset lap type joint (see FIGS. 14 and 15) which provides visual privacy through the fence but allows for air to move between the lap joints of the two respective panels. The panel edge 16 also includes contact pads 18 at space points along the panel edge 121 to provide abutting contact surfaces between the two fence panels.

Connectors 20 serve to connect the fence panels to the post 6. These connectors slide over the projecting ends of the horizontal members 10 and the wood reinforcing members 131. These reinforcing members extend across the length of the plastic fence section between two spaced posts 6. Basically, the reinforcing members act as horizontal supports and the fence panel section is hung on these reinforcing members.

Figures 7, 8:
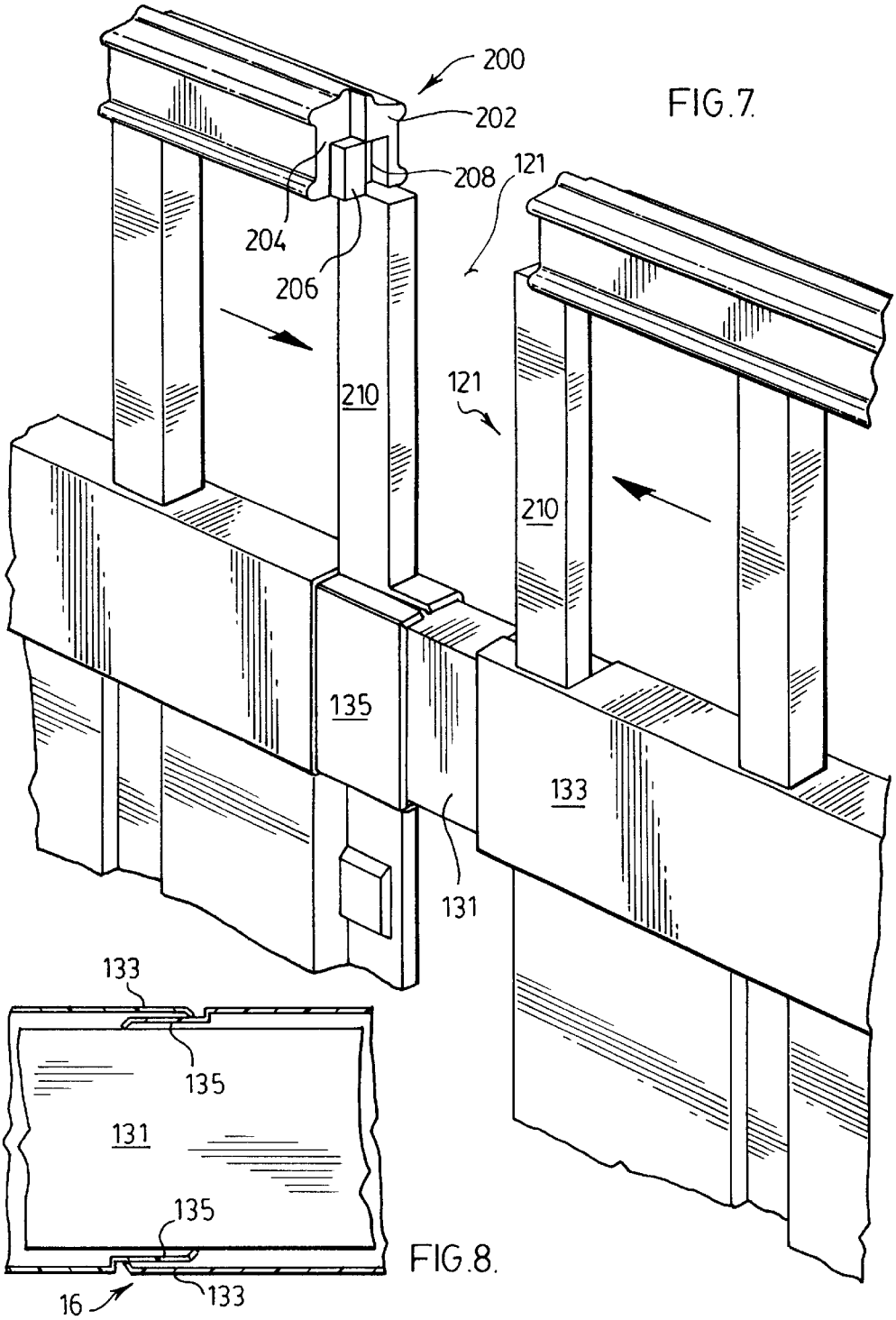
FIG. 7 is an exploded partial perspective view of two panels being joined in the center of the fence section.
FIG. 8 is a horizontal section through one of the horizontal reinforcing members.
Figure 9:
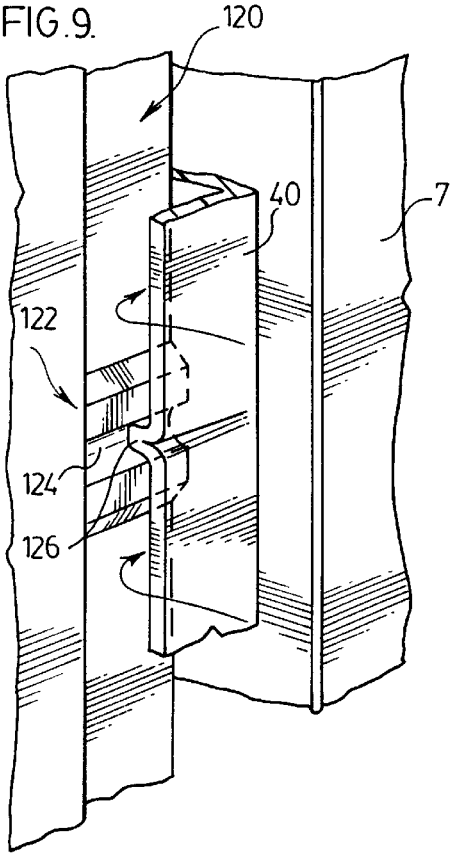
FIG. 9 is a partial perspective view of the fence panel showing the edge of the panel adjacent a post.
Figure 10:
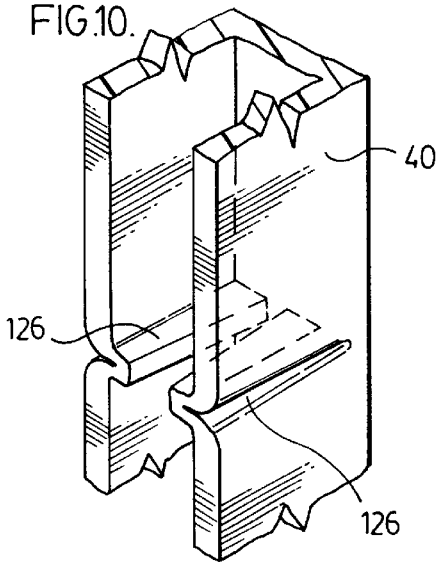
FIG. 10 is a partial perspective view of the C-shaped channel.

The lap joint is shown in FIGS. 7 and 8. Basically end 133 overlies inset end 135. This overlap joint also serves to center the two by four 133. Each panel can be mechanically fastened by screws on the lower surface of member 10 to the two by four. With this arrangement, expansion movement occurs at the post edge 120 and is accommodated by the C-shaped channels 40. Any contraction at the slip joint 16 does not reveal the two by four.

FIG. 7 also shows an overlap plug fit provided at the center joint between two panels. The top rail 200 interfits with the opposed panel to maintain alignment of the rails. The projection 202 has an adjacent recess 204 and projection 206 has an adjacent recess 208. Half piller 210 abuts and overlaps with half piller 210 of the adjacent panel.

There is a requirement in a plastic fence section to allow for thermal expansion. To accommodate this, the post engaging edge 120 includes a number of raised blocks 122 with centre slots 124 which cooperate with C-shaped members 40 to provide a visual block between the post and the panel edge. The C-shaped members include on the sidewalls, opposed wedge members 126 which are received in the slots 124 of the raised blocks 122. The raised blocks 122 cooperate with the C-shaped members to provide a spring bias forcing the C-shaped member against the post. The C-shaped members are effectively trapped by the post and the panel, and the legs of the C-shaped member extend over the panel edge. During thermal expansion of the panel, some outward spreading of the C-shaped member, and some inward compression of the raised blocks will occur, and provides a returnable spring bias forcing the C-shaped members 40 against the respective post. In this way, the panel can move relative to the C-shaped member while the C-shaped member continues to provide a spring bias, urging it against the post. This arrangement allows for thermal expansion of the fence panels while continuing to provide a visual block along the length of the fence. The C-shaped channels cannot slide up or down as they are trapped by the horizontal members and are also held in place by recess 124 engaging members 126.

The horizontal rails 10 include at the post engaging edge, inwardly directed ribs to center the two by four reinforcement member 133.

Figure 5:
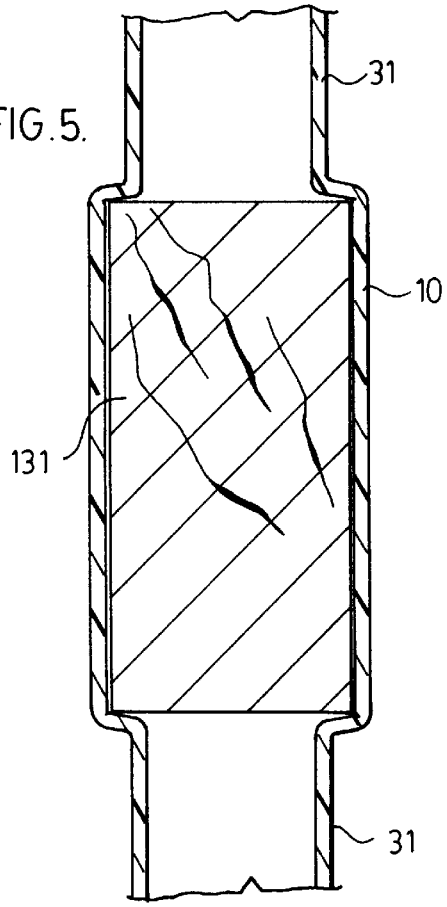
FIG. 5 is a partial vertical section through one of the chambers for receiving a reinforcing member and through one of said vertically extending chambers.

FIG. 5 is a partial sectional view through one of the horizontal members showing the plank extending above and below the horizontal member with the planks being interrupted by the horizontal member 10.

Figure 6:
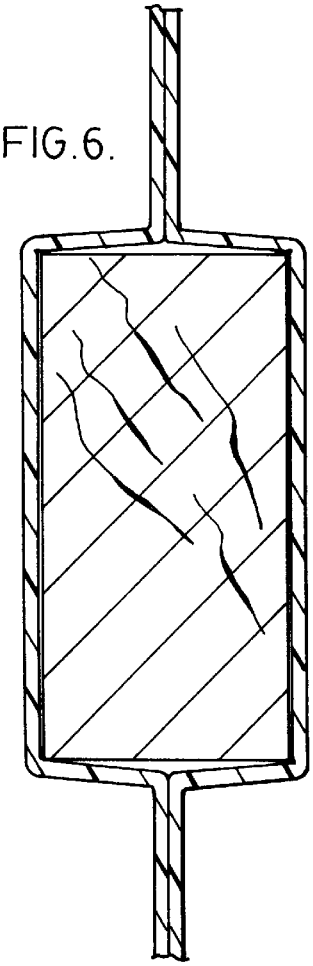
FIG. 6 is a vertical section similar to FIG. 5 but through a vertically extending pinch off region.

In contrast, FIG. 6 is a sectional view through one of the pinch offs 32 and in this case, it can be seen how the pinch offs define a double wall thickness as in blow molding, the pinch off is the result of both plastic layers being brought together.

The partial exploded perspective view of FIG. 7 illustrates two spaced fence panels 4 about to be joined with reinforcing members 131 extending out of the horizontal chambers 10 of each panel section.

FIG. 4 is a partial sectional view showing one fence panel 4 in combination with a length of the C-shaped channel which is also formed as part of the blow molding process and is attached to the fence panel 4. The blow mold product is cut or trimmed at line A—A leaving the C-shaped channel outwardly facing. The end user cuts the C-shaped channel from the panel along line B—B. The channel is then reversed for securement. Each edge includes four channels. In this way, the produced product includes the C-shaped channel and is shipped to the retailer as a single component. This will reduce stocking problems and will also ensure that each panel section is sold with a C-shaped channel for providing privacy adjacent the post. The shipped product is stackable on a four foot by six foot pallet and therefore, is easily warehoused and shipped through the distribution chain. The panel section is approximately four foot by six foot and is relatively light and easily transported.

FIG. 3 shows a perspective view of the connector 20 for attachment to a post. The connector includes an open centre port 63 for sliding over the end of a horizontal reinforcing member 131 and this arrangement simplifies the installation of the fence section to the post. Typically, two panels are interconnected by inserting the various horizontal reinforcing members into the panels and then this combined unit is secured by the connectors between two posts (see FIG. 1). The connectors are slipped on the ends of the reinforcing members. The connectors include ports 23 and slots 25 for attaching the connector to a post. The slots are on the lower flanged edge of the connector and the ports 23 are on an upper flanged edge of the connector. The posts can have screws already secured for receipt in the slots 25 of the connector. In this way, the fence section with the two panels, and the reinforcing members, and the connectors, can be assembled on the ground and lifted into place between the posts. The connectors slide onto the previously positioned screws and approximately position the fence section. The fence section can then be adjusted and secured in its final position.

In yet a further alternate design, the top portion of the fence section can continue to have rail 200, however, a lattice screen is provided between the rail and the uppermost rail 10 and between the uprights 15 of FIG. 1. The lattice could also generally fill this upper area.

The fence panel provides a finished surface to both sides thereof and is considered a good neighbour fence.

Figure 16:
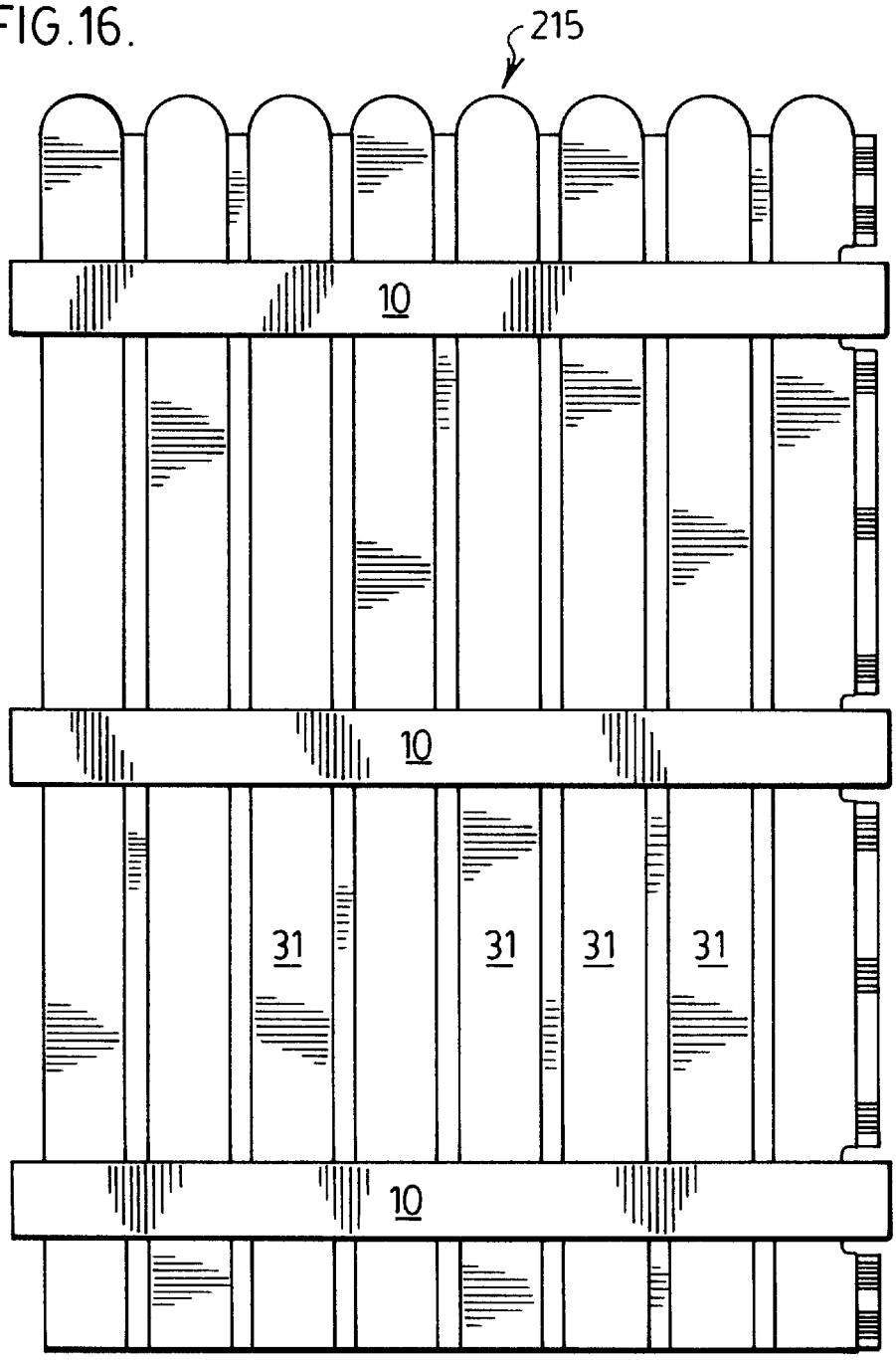
FIG. 16 shows an alternate top detail.

FIG. 16 shows an alternate top detail 215 which can be used. In this case, the planks extend above the upper horizontal member and provides the finished upper detail. This fence panel design is preferrably manufactured using blow mold techniques and the material is preferrably high density polyethylene. The fence panel section of FIG. 1 requires the removal of flashing between the upright members 15. Flashing can be removed by manual cutting or in an automated manner. The cutting or removal of the flashing is carried out at the time the product is manufactured and is simplified due to the fact the plastic material is still somewhat warm.

Figure 17:
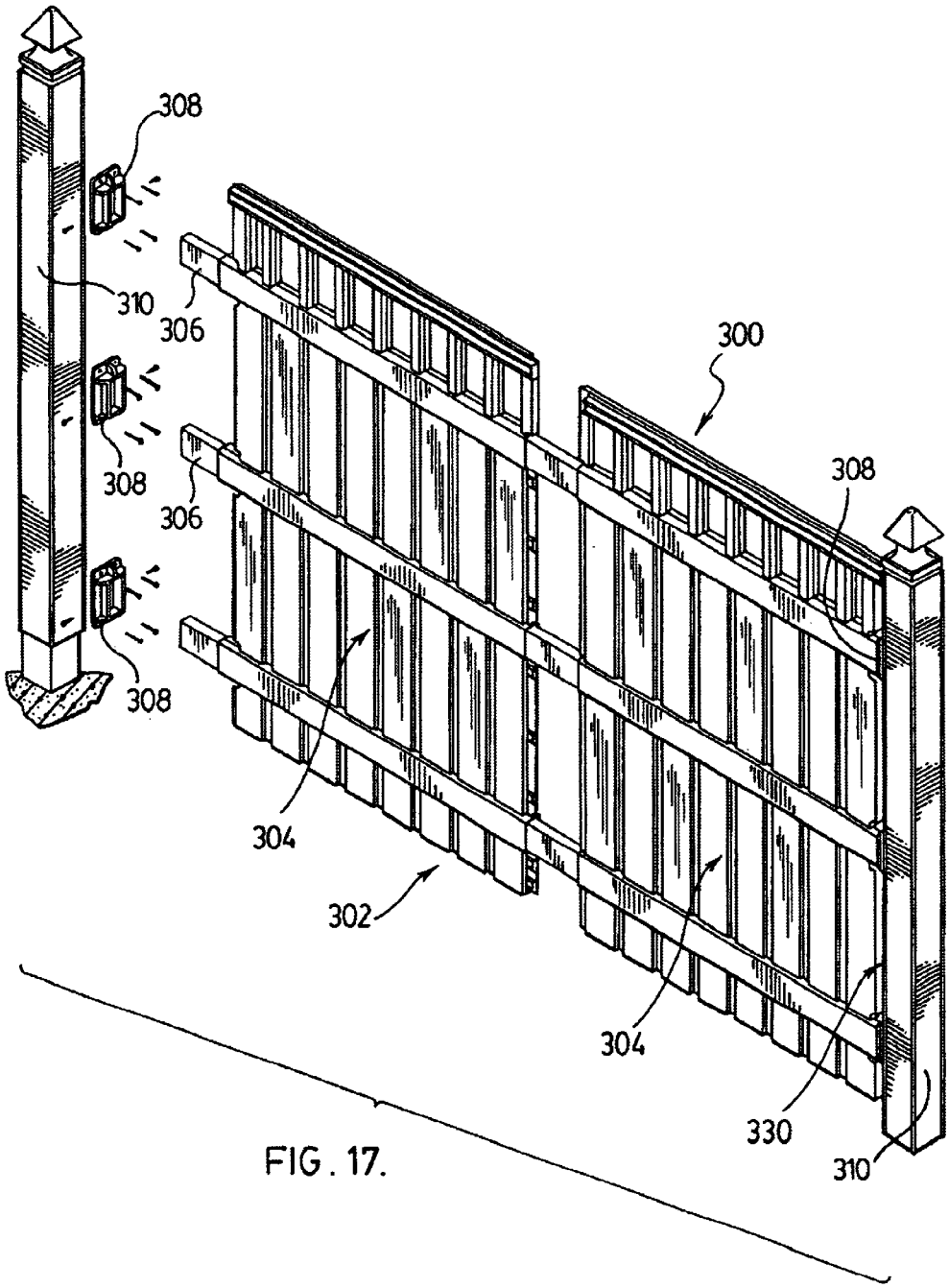
FIG. 17 is a perspective view of an alternate embodiment.
Figure 18:
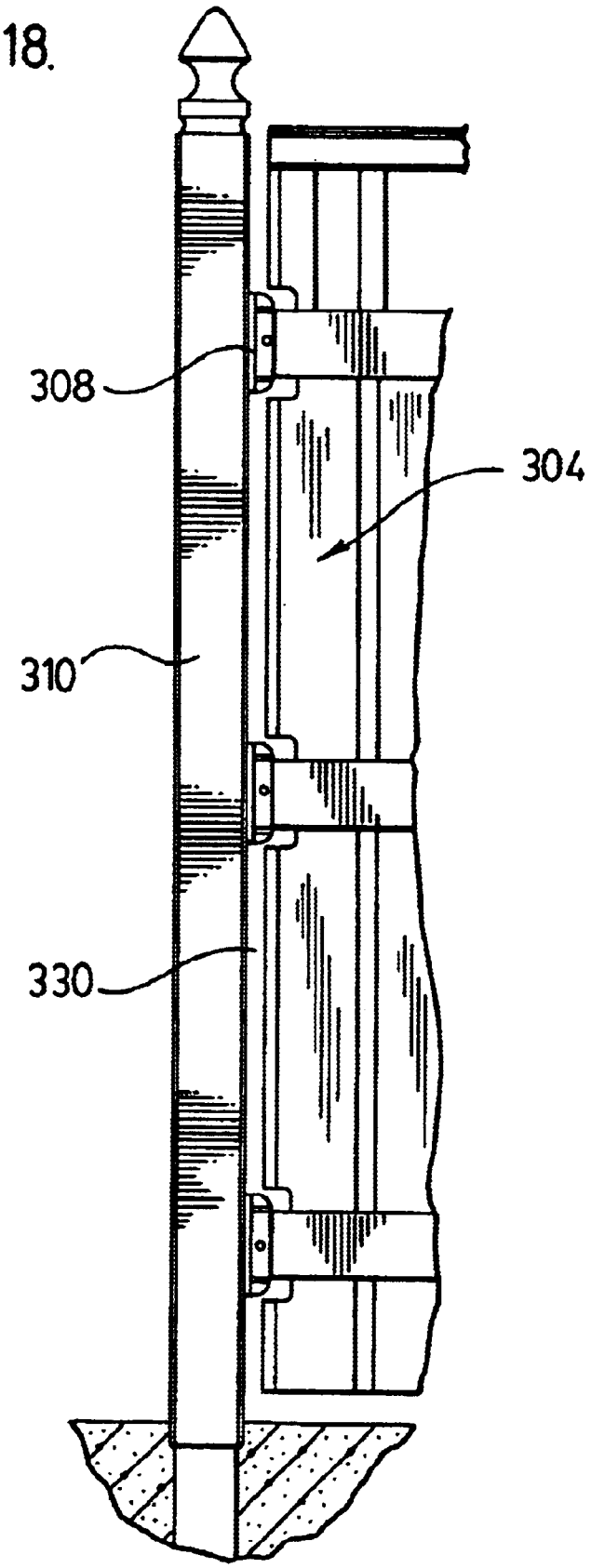
FIG. 18 is a partial front view of an alternate partition panel connected to a post.

FIG. 17 and FIG. 18 show an alternate system 300 where the C-shaped members provided between a post cover and the partition panel have been removed.

FIG. 17 shows the alternate system 300 having one fence section 302 defined by the two fence partitions 304 supported between opposed posts. Three two-by-fours 306 are received within the channels of the fence partitions 304 and extend between the opposed posts. Connectors 308 are positioned on the two-by-fours and are then connected to the posts through the post cover and cap 310. As in the earlier embodiments, the fence partitions are abutted at the center of the fence section and are preferrably mechanically fastened to the two-by-fours by a screw connector such that the two fence partitions are joined at the center of the fence section. The fence sections are of a blow molded plastic and there will be some thermal expansion of these partitions. The partitions are basically free to expand towards the adjacent post.

The embodiment shown in FIG. 17 has very few sku's. The fence system requires the connectors 306 and the fence partition 304 and preferrably, the post cover and cap 310. The four by fours that are used for the post are already available at lumber stores, and this is also true of the two by fours used as horizontal connectors.

FIG. 18 shows a gap 330 between the edge of the fence section 304 and the post cover and cap 310. This gap reduces the visual privacy of the fence system, however, in most cases, this is acceptable. The gap also assists in reducing the wind load that the fence section 302 must withstand. The reduction in the visual privacy is not as substantial as might be initially considered in that the four-by-four post extends either side of the fence partition and thus, the maximum visual gap is when one is directly in front of the gap. The edge of the fence partition 304 is merely a straight bead section centered on the fence section.

Although various preferred embodiments of the present invention have been described herein in detail, it will be appreciated by those skilled in the art, that variations may be made thereto without departing from the spirit of the invention of the scope of the appended claims.

The embodiments of the invention in which an exclusive property or privilege is claimed are defined as follows:

1. A plastic privacy fence section comprising an upper hollow horizontal member and a lower horizontal member with both horizontal members extending the length of the fence section and forming hollow cavities for receipt of a reinforcing member, said privacy fence section comprising an upper top finish portion, a middle portion between said horizontal members and a bottom portion extending below said lower horizontal member, each of said middle and bottom portions comprising a series of hollow chambers separated by exposed non hollow pinch off regions of additional thickness relative to the thickness of the walls of said hollow chambers, said portions of said privacy fence section cooperating with said horizontal members to provide a visual block across the width and height of said middle and bottom portions of the privacy fence section, and wherein said fence section is a single integral molded component.

2. A plastic privacy fence section as claimed in claim 1 wherein said section is a blow molded component.

3. A plastic privacy fence section as claimed in claim 1 wherein said section between opposed vertical edges is symmetrical relative to the vertical plane extending along the section.

4. A plastic privacy fence section as claimed in claim 3 wherein said section includes a post joining section at one vertical edge of the section and a slip joint edge on an opposite edge of the section.

5. A plastic privacy fence section as claimed in claim 1, wherein said hollow chambers are approximately five inches in width and the pinch off regions between adjacent hollow chambers are approximately one inch in width.

6. A plastic privacy fence section as claimed in claim 1, including an intermediary horizontal reinforcing member located between said upper and lower horizontal members and extending the length of said fence section.

7. A plastic privacy fence section comprising an upper hollow horizontal member and a lower horizontal member with both horizontal members extending the length of the fence section and forming hollow cavities for receipt of a reinforcing member, said privacy fence section comprising an upper top finish portion, a middle portion between said horizontal members and a bottom portion extending below said lower horizontal member, each of said middle and bottom portions comprising a series of hollow chambers separated by exposed non hollow pinch off regions of additional thickness relative to the thickness of the walls of said hollow chambers, said portions of said privacy fence section cooperating with said horizontal members to provide visual block across the width and height of said middle and bottom portions of the privacy fence section, and wherein one vertical edge of the section is adapted for positioning adjacent a post and the opposite vertical edge of the section has an offset lap joint edge.

8. A plastic privacy fence section as claimed in claim 7, wherein said top finish portion at said lap joint edge includes offset male and female portions for connecting with a similar fence section.

9. A plastic privacy fence section as claimed in claim 8 wherein said top portion includes a series of open ports.

10. A plastic fence section for securement between two end posts comprising two identical panels, each panel including a post engaging edge and a panel joining edge, said panels being reversible such that the post engaging end can be positioned to form the right edge or the left edge of the fence section, each panel including at least two parallel horizontal chambers extending across said panels and joining with the respective horizontal chambers of the other panel, and two reinforcing members extending through said horizontal chambers and extending the length of said fence section; said panel joining edge of each panel including interlocking surfaces which interfit with the interlocking surfaces of the joining panel; and wherein the panel joining edge is divided vertically and said interlocking surfaces provide at least one male interfitting surface to one side of the vertical division and a corresponding female interfitting surface to the opposite side of the vertical division.

11. A plastic fence section as claimed in claim 10 wherein each panel includes three parallel horizontal chambers extending across said panels, and each chamber can receive an elongate reinforcing member therein extending the length of the fence section.

* * * * *